US007285005B2

(12) United States Patent
Gabrielsson et al.

(10) Patent No.: US 7,285,005 B2
(45) Date of Patent: Oct. 23, 2007

(54) LOCKING ELEMENT FOR AN ELECTRICAL CONNECTOR

(75) Inventors: Per Georg Gabrielsson, Hässelby (SE); Bart Theo Maria Verreydt, Hofstade/Zemst (BE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/564,681

(22) PCT Filed: Jul. 5, 2004

(86) PCT No.: PCT/EP2004/051354

§ 371 (c)(1),
(2), (4) Date: Sep. 22, 2006

(87) PCT Pub. No.: WO2005/015694

PCT Pub. Date: Feb. 17, 2005

(65) Prior Publication Data

US 2007/0059962 A1 Mar. 15, 2007

(30) Foreign Application Priority Data

Jul. 17, 2003 (NL) ..... 1023937

(51) Int. Cl.
*H01R 13/627* (2006.01)

(52) U.S. Cl. ..... 439/378; 439/362

(58) Field of Classification Search ..... 439/353, 439/357, 362, 378

See application file for complete search history.

(56) References Cited

U.S. PATENT DOCUMENTS 3,394,337 A * 7/1968 Miller ..... 439/353
3,810,073 A * 5/1974 Zajac et al. ..... 439/352
4,655,527 A 4/1987 Vandame ..... 339/91
4,669,797 A * 6/1987 Bourdon ..... 439/353
4,980,800 A * 12/1990 Furuta ..... 361/727
5,044,975 A * 9/1991 DiBene et al. ..... 439/352
5,411,402 A 5/1995 Bethurum ..... 439/77
5,601,446 A 2/1997 Wright ..... 439/357
6,007,364 A * 12/1999 Wu ..... 439/378
6,012,939 A * 1/2000 Kunert et al. ..... 439/362
6,074,236 A * 6/2000 Wu ..... 439/378
6,347,955 B1 * 2/2002 Huang ..... 439/378
6,669,510 B2 * 12/2003 Yamawaki et al. ..... 439/595
7,040,910 B2 * 5/2006 Nagata et al. ..... 439/352
2001/0006857 A1 * 7/2001 Eppe et al. ..... 439/357
2004/0087202 A1 * 5/2004 Baccei et al. ..... 439/378

FOREIGN PATENT DOCUMENTS

EP 0 709 928 A2 5/1996

(Continued)

*Primary Examiner*—Tho D. Ta
(74) *Attorney, Agent, or Firm*—Harrington & Smith, PC

(57) ABSTRACT

The invention relates to a locking element for locking and unlocking a cable connector and a counterpart, said locking element extending along a longitudinal axis between a rear side and a mating side. At the mating side two or more resilient beams extend substantially parallel to the longitudinal axis and contain one or more locking structures including an insertion surface and a locking surface building an angle with the longitudinal axis. The insertion surface and locking surface have an inclined orientation with respect to the longitudinal axis wherein the angle of the locking surface is larger than the angle of the insertion surface but substantially smaller than 90 degrees. The invention further relates to a connector system wherein one or more of these locking elements are applied to connect a cable connector and a board connector.

16 Claims, 8 Drawing Sheets

FOREIGN PATENT DOCUMENTS

EP 1 133 025 A2 9/2001

EP 1 282 200 A2 2/2003

* cited by examiner

LOCKING ELEMENT FOR AN ELECTRICAL CONNECTOR

BACKGROUND OF THE INVENTION

The invention relates to a locking element for locking and unlocking a cable connector and a counterpart, said locking element extending along a longitudinal axis between a rear side and a mating side, said mating side comprising two or more resilient beams extending substantially parallel to said longitudinal axis and containing one or more locking structures comprising an insertion surface and a locking surface disposed at angles with said longitudinal axis.

U.S. Pat. No. 6,511,339 discloses a cable connector assembly comprising a plug connector and a push lock retained in that plug connector by a retaining portion. The push lock comprises an annular peripheral fastener disposed on elastic beams forwardly from the retaining portion for locking to a receptacle connector. The receptacle connector comprises a groove for engaging with the fastener of the plug connector. The elastic beams can be manipulated by squeezing a press portion to connect or withdraw the plug connector from the receptacle connector.

The prior art locking approach is disadvantageous in that the locking element is not generally applicable as one or more components of the cable connector assembly have to be adapted to allow the locking element to attach the components to each other, e.g. by providing an additional groove.

It is an object of the present invention to provide a locking element enabling locking of the components of a connector system without requiring any adaptation of these components.

BRIEF SUMMARY OF THE INVENTION

This object is achieved by providing a locking element characterized in that said insertion surface and said locking surface have an inclined orientation with respect to said longitudinal axis wherein said angle of said locking surface is larger than said angle of said insertion surface but substantially smaller than 90 degrees. Such a locking element can be easily inserted by pushing in a simple hole in the counter part that is typically present for insertion of a screw or the like. The inclination of the insertion surface is small to reduce the required insertion force. The locking element may be attached to the cable connector and locks the cable connector to the counterpart by means of the locking surface that interferes with the counterpart after the locking structure has been pushed through the hole in the counterpart. As the cable connector may need to be unlocked from the counterpart, the angle of the locking surface is substantially smaller than 90 degrees, such that the locking element can be released simply by pulling. Preferably, the insertion surface and the locking surface substantially determine the shape of the locking structure. Thus the invention provides a generally applicable locking element, that may e.g. replace a screw that is conventionally applied for locking a cable connector to a counterpart, such as a board connector or panel.

In an embodiment of the invention a solid of revolution of said locking structure comprises a substantially conically shaped portion. Such a portion of the locking structure may be determined by a first solid of revolution having a first substantially conical shape and a second solid of revolution having a second substantially conical shape and wherein said insertion surface is determined by a surface of said first substantially conical shape and said locking surface is determined by a surface of said second substantially conical shape. The conical geometry of the locking structure is advantageous from a manufacturing point of view as the locking element may have a circular symmetric geometry.

In an embodiment of the invention the locking element comprises one or more slits. In such a construction of the locking element, the resilient beams are an integral part of the locking element. Preferably the resilient beams are such that they are stronger near the bottom of the slit.

In an embodiment of the invention the locking element comprises a hole at or near the mating side determining said resilient beams. Such a construction of the locking element is more robust as the beams meet at the mating end of the locking element.

In a preferred embodiment of the invention the mating ends of said resilient beams are rounded off. Such a smooth interface avoids severe damage of e.g. the thread in the hole of the counterpart during the insertion of the locking element.

In a preferred embodiment of the invention the locking element comprises a retaining structure adapted to keep the locking element attached to either the cable connector or the counterpart. Such a retaining structure allows for pre-integration of the locking element in either the cable connector of the counterpart as a consequence of which installation in the field is facilitated.

The invention also relates to a connector system comprising a cable connector and a board connector, wherein one or more locking elements are applied to connect said cable connector and board connector, said locking elements having a locking structure and extending along a longitudinal axis between a rear side and a mating side. The locking structure is disposed on one or more resilient beams extending substantially parallel to said longitudinal axis. The locking element moreover allows quick installation and removal of cable connectors from a panel as locking and unlocking is accomplished by simply pushing or pulling the locking elements enabled by the resilient beams on e.g. a backpanel in telecom industry. The connection between the cable connector and board connector may be electrical or optical.

Preferably the locking structure comprises an insertion surface and, more preferably, also a locking surface having an inclined orientation with respect to said longitudinal axis wherein the inclination angle of said locking surface is larger than the inclination angle of said insertion surface but substantially smaller than 90 degrees. In such an embodiment conventional cable connectors and board connectors can be applied while the conventionally applied screws for locking the components can be replaced by the locking element according to this embodiment. The locking element may further comprise the features as described above.

The locking elements may have different lengths along the longitudinal axis, thereby allowing to match different reference planes in the connector system.

The cable connector and the board connector may connect to each other via an aperture in a panel, such as a backpanel. The locking element may comprise a retaining structure that is adapted to keep said locking element attached to said panel. In this reverse situation the locking element is part of or integrated in the backpanel and engages with e.g. a hole in the cable connector.

BRIEF DESCRIPTION OF THE SEVERAL VIEWS OF THE DRAWINGS(S)

The invention will be further illustrated with reference to the attached drawings, which shows a preferred embodiments according to the invention. It will be understood that the locking element and the connector system according to the invention are not in any way restricted to this specific and preferred embodiment.

DETAILED DESCRIPTION OF THE INVENTION

Figure 1:
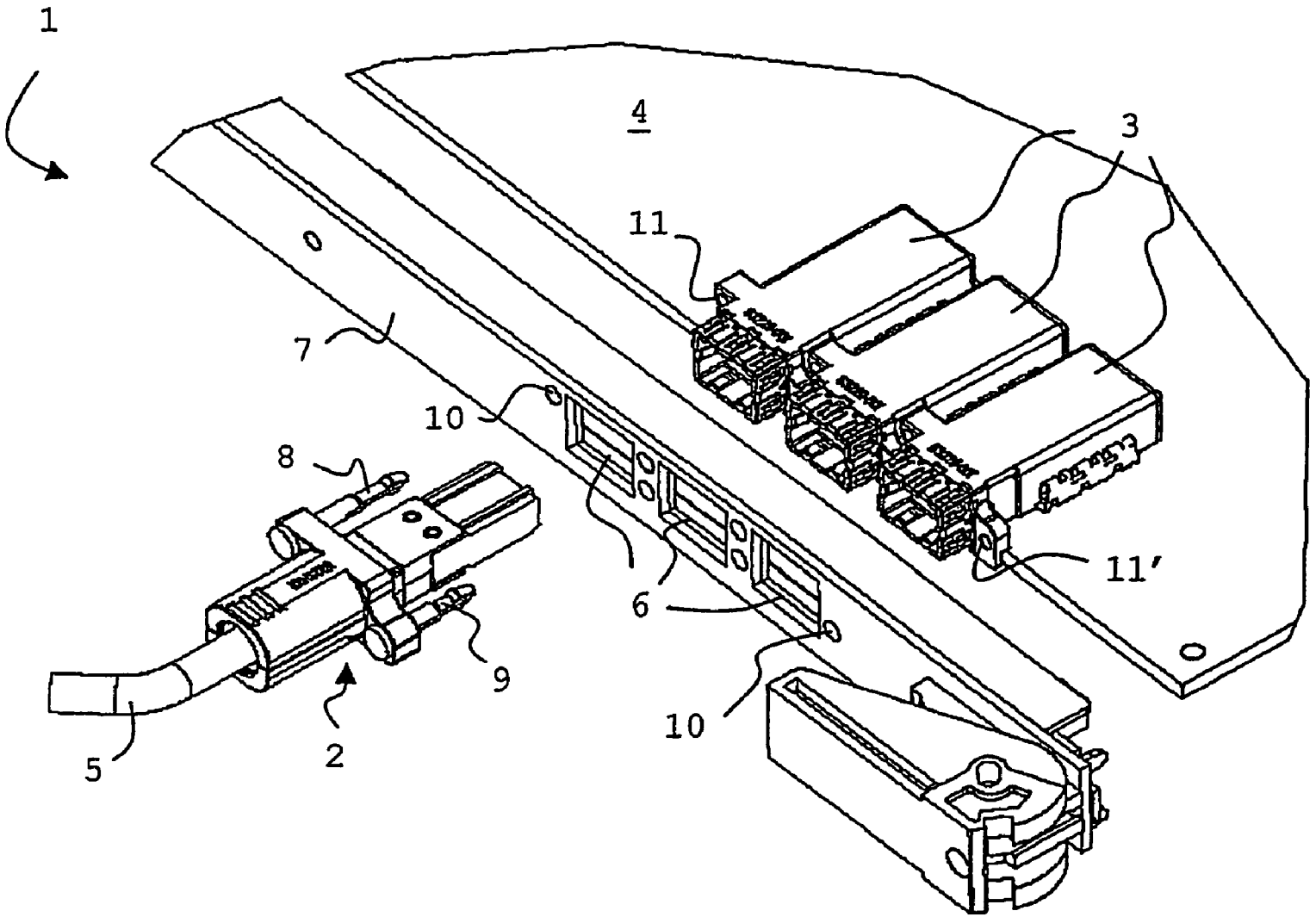
FIG. 1 shows an overview of a connector system according to an embodiment of the invention.
Figure 2:
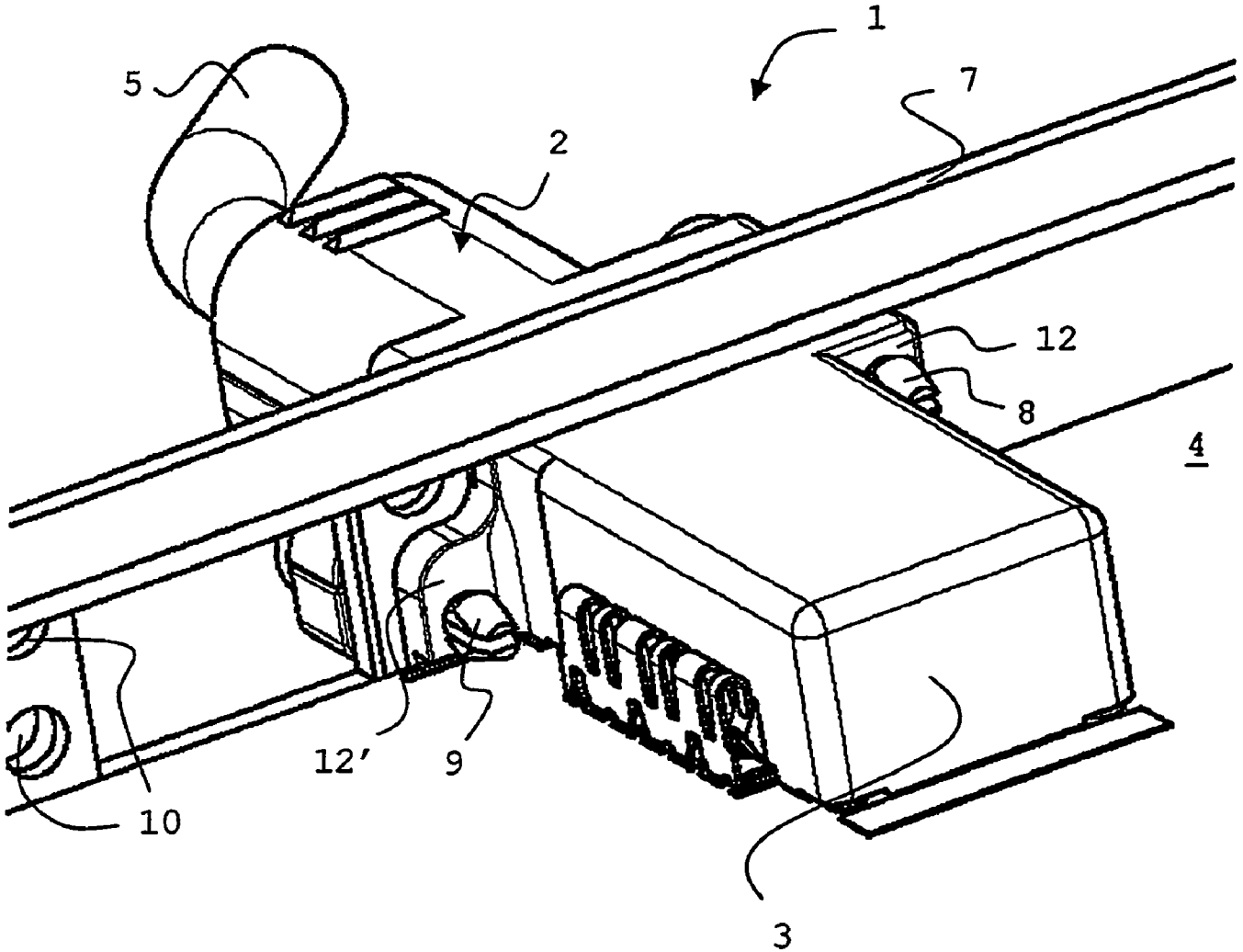
FIG. 2 shows a more detailed view of a connector system wherein the cable connector is locked.

FIGS. 1 and 2 show an overview of a connector system 1 comprising a cable connector 2, board connectors 3 positioned on a circuit board 4. The cable connector 2 connects wires (see FIG. 3) of a cable 5 via the board connector 3 to signal tracks (not visible) of the circuit board 4 if the cable connector 2 is connected to the board connector 3. To establish this connection the cable connector 2 is inserted in an appropriate aperture 6 of a panel 7. The cable connector 2 is locked to the board connector 3 by insertion of the locking elements 8 and 9 through openings 10 in the panel 7 and holes 11 and 11' in the board connector 3. The openings and/or holes 11 may comprise a thread as they usually do to engage with a jack screw to enable conventional locking. The holes 11 and 11' are conventionally manufactured in flanges of the board connector 3. The surfaces 12 and 12' provide reference planes for the locking operation according to the invention. The locking elements 8 and 9, hereinafter also referred to as pins, are described in more detail below.

Figure 3:
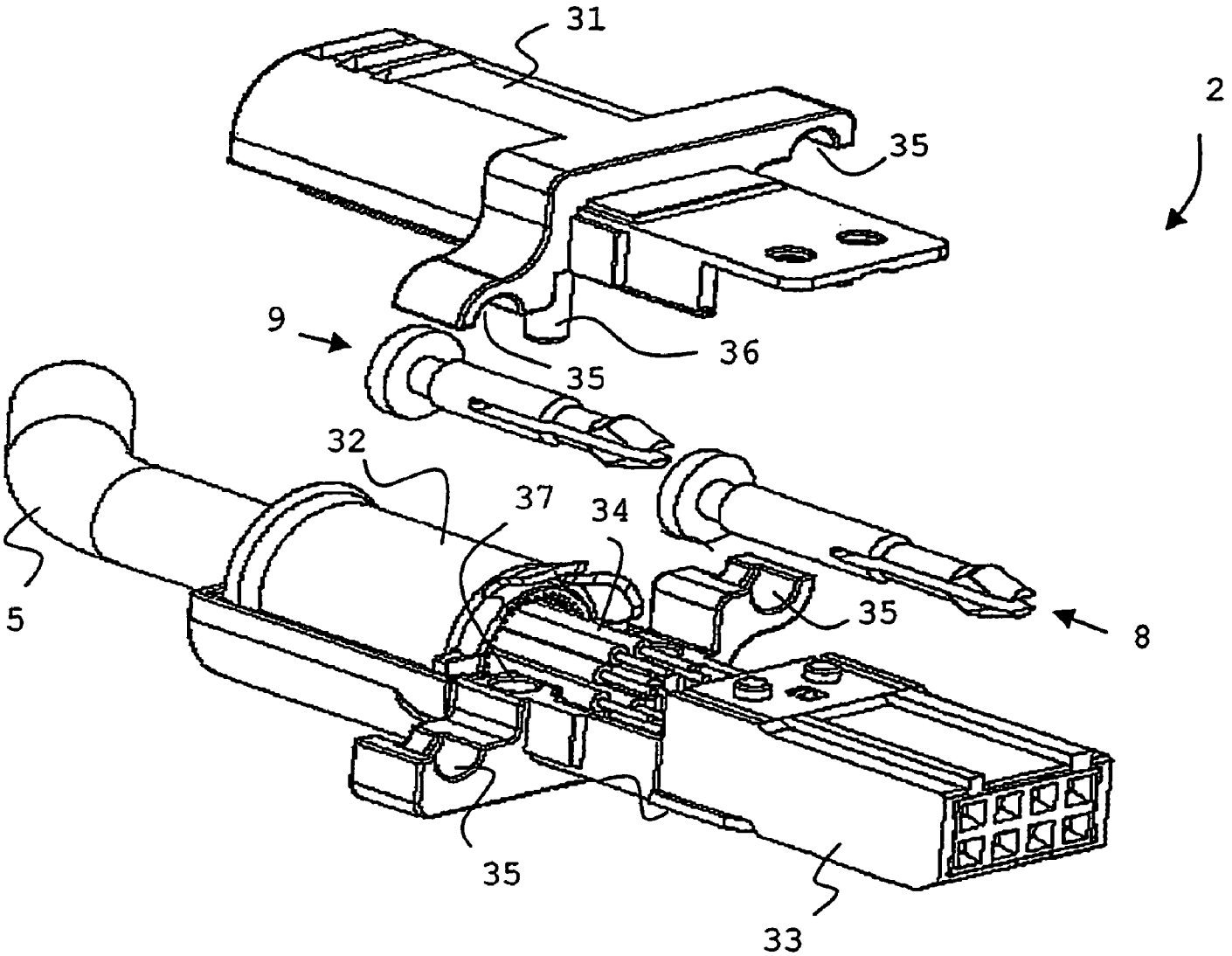
FIG. 3 shows an exploded view of a cable connector for use in a connector system according to an embodiment of the invention.

FIG. 3 shows an exploded view of the cable connector 2 shown in FIGS. 1 and 2. The cable connector 2 comprises housing parts 30 and 31 adapted to accommodate a ferrule arrangement 32 and a connecting element 33 terminating wires 34 of the cable 5. This cable connector is a conventional connector that is well known in the connector field. Typically the recesses 35 provide openings to accommodate screws to lock the cable connector 2 to a counterpart. However, according to an embodiment of the invention these conventionally present openings are used to accommodate the pins 8, 9 to lock the cable connector 2 to the board connector 3. The pins 8, 9 may be preinstalled in the cable connector 2 by applying the pins in the recesses 25 and closing the housing parts 30, 31. This closing is facilitated by the pillars 36 and corresponding holes 37.

Figure 4B:
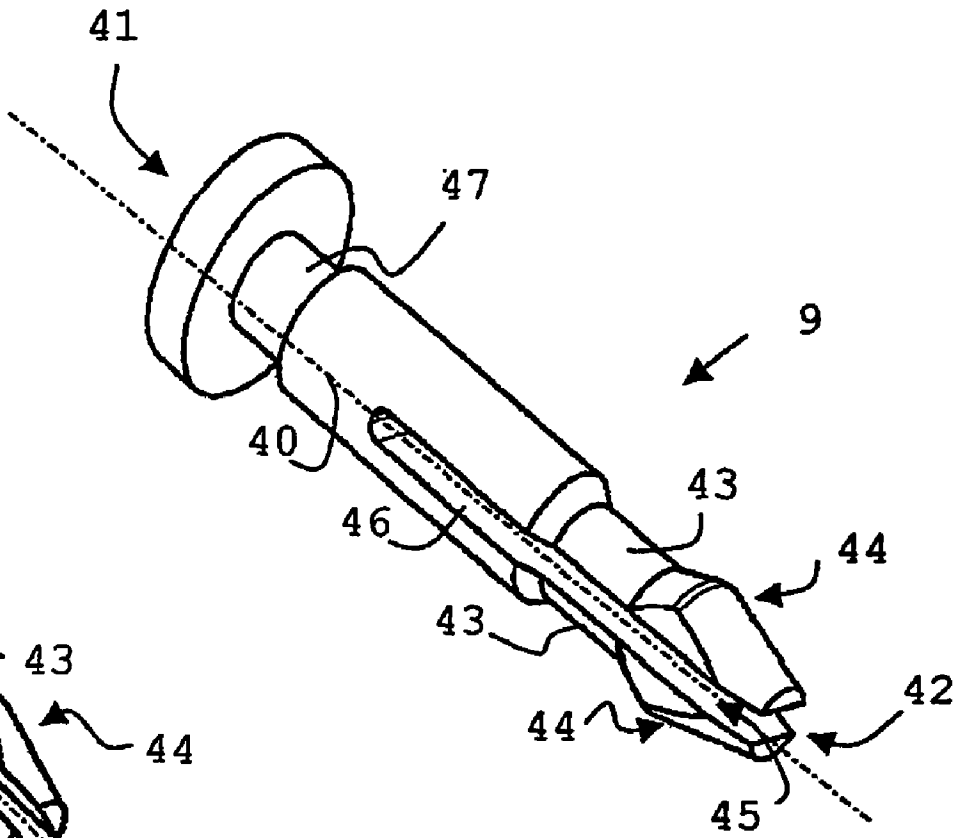
FIGS. 4A and 4B show a locking element according to a first embodiment of the invention.
Figure 4A:
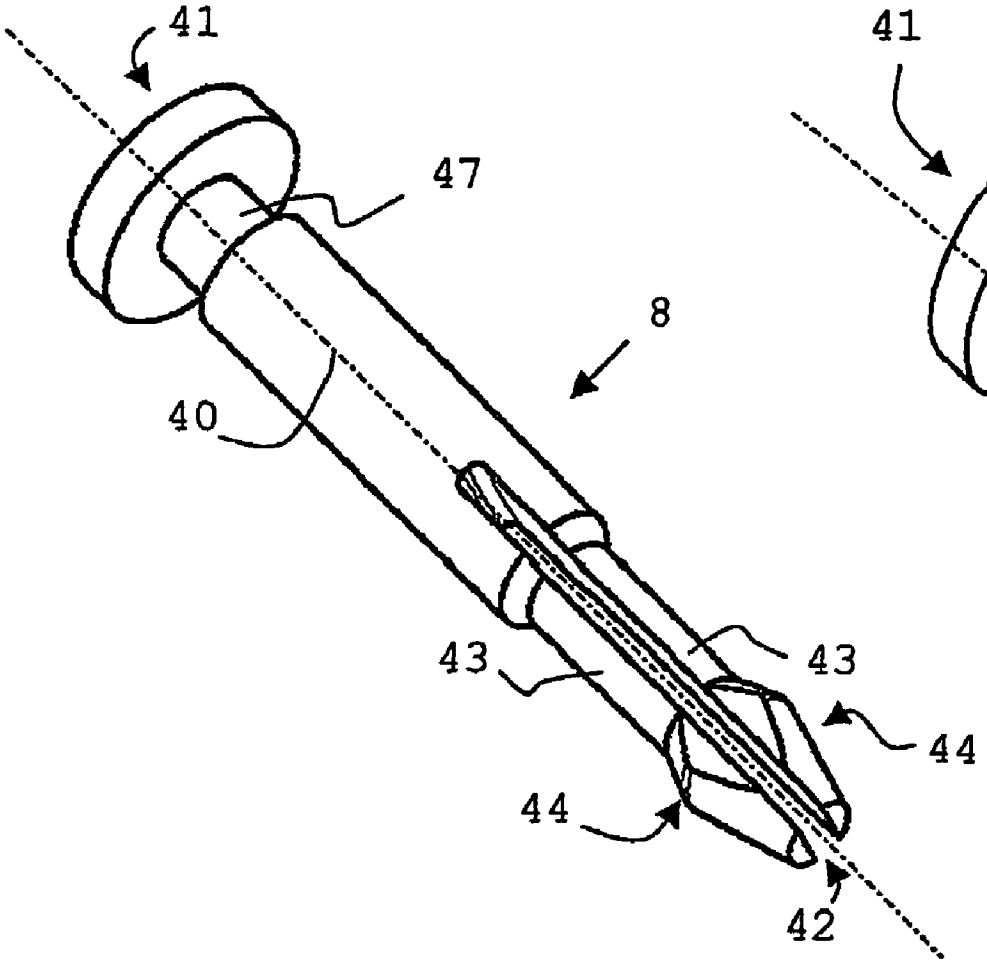

FIGS. 4A and 4B show a long pin 8 and a shorter pin 9 according to a first embodiment of the invention and extending along a longitudinal axis 40 between a rear side 41 and a mating side 42. The short pin 9 may e.g. measure 15 mm along the longitudinal axis 40, while the long pin 8 measures 20 mm. Pins of different length are advantageous as the holes 11 and 11' may be at different distances behind the panel 7 (see FIG. 1) such that the reference faces 12, 12' (see FIG. 2) for locking are different for the pins 8 and 9 respectively. The pins 8, 9 comprise resilient beams 43 that extend substantially parallel to the longitudinal axis 40 and contain locking structures 44. A slit 45 is determined by the walls 46 of the beams 43. It is noted that the pins 8, 9 may contain more slits 45 such that more resilient beams 43 are provided and one or more of these beams may contain a locking structure 44. The pins 8, 9 comprise retaining structures 47, here in the form of a groove, that enable the pins 8, 9 to remain in a cable connector 2.

Figure 5A:
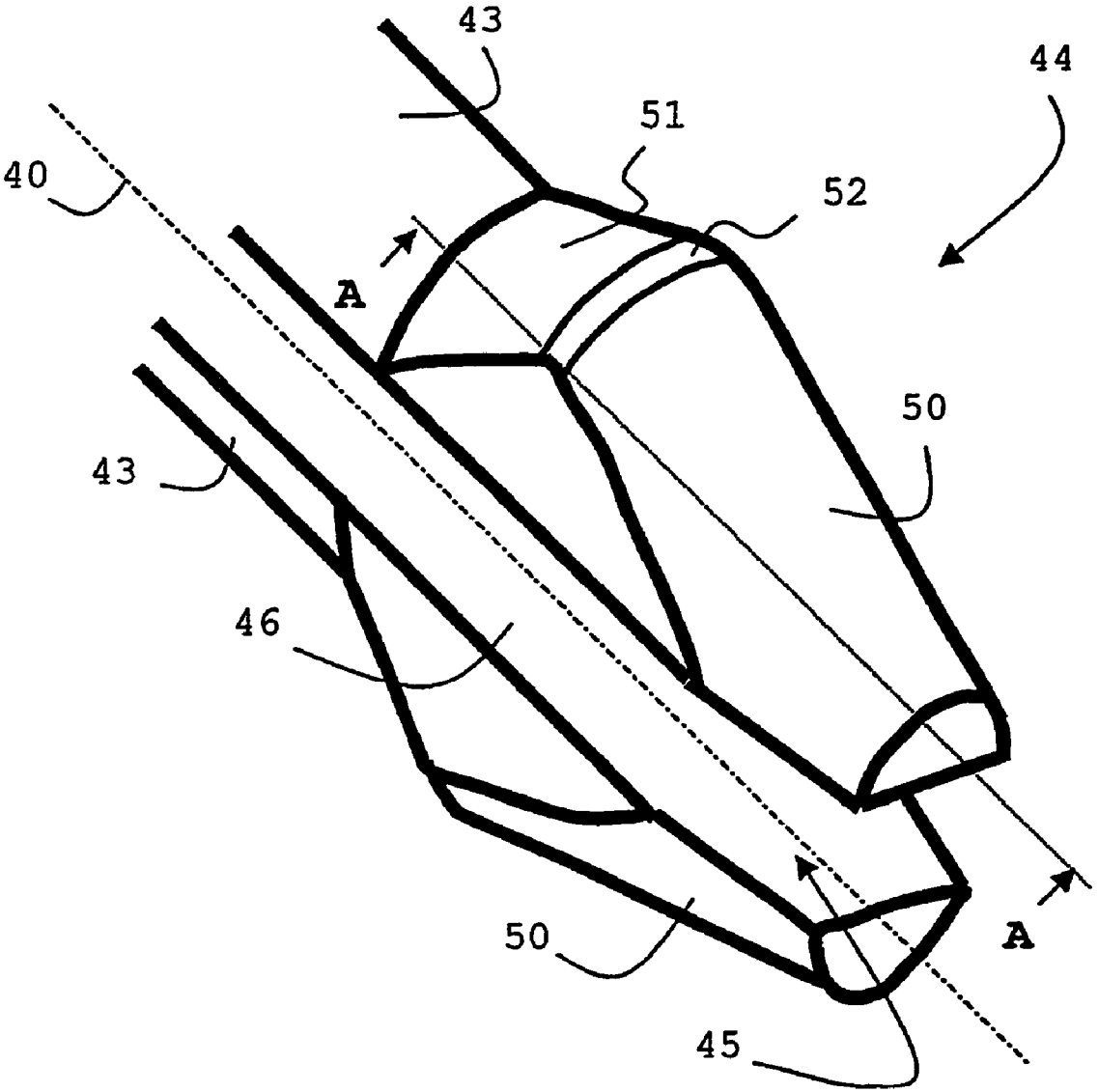
FIGS. 5A-5C show a detailed view in perspective, in cross-section A-A an in top view of a locking structure of the locking element as displayed in FIG. 4B.
Figure 5B:
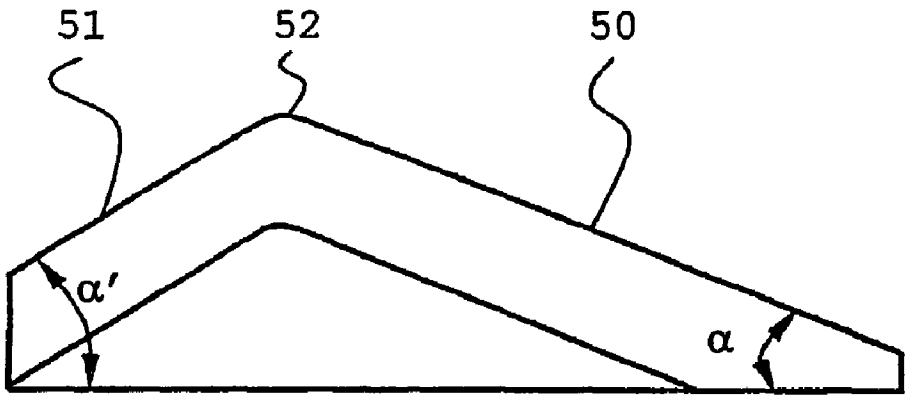
Figure 5C:
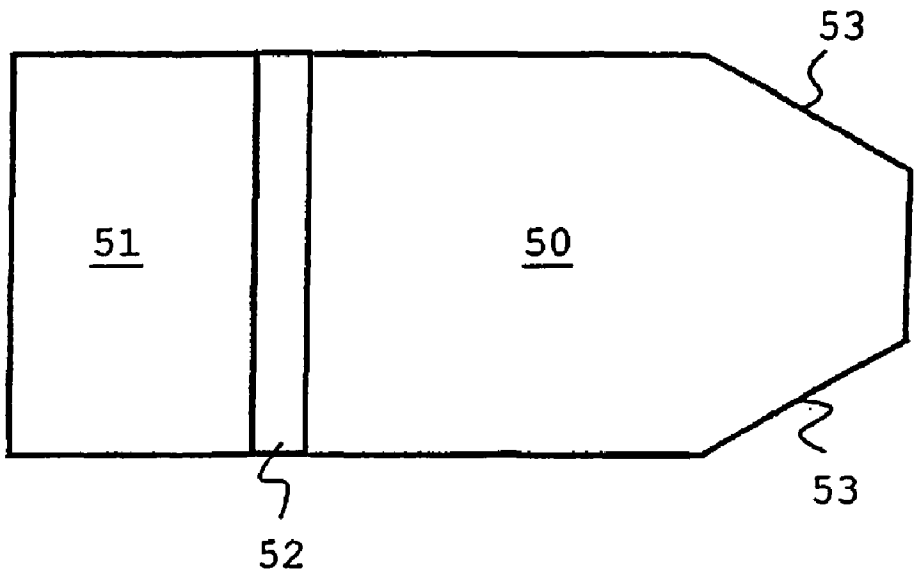

FIGS. 5A-5C shows a detailed view of a conically shaped locking structure 44 of the pin 9 as displayed in FIG. 4B. The locking structure comprises a ramp having an insertion surface 50 and a locking surface 51 with an inclined orientation over angles $\alpha$ and $\alpha'$ respectively with respect to the longitudinal axis 40. Apart from the small connecting portion 52, the insertion surface 50 and locking surface 51 entirely determine the locking structure 44. In FIG. 5A the locking structure 44 is determined by a first solid of revolution having a first substantially conical shape and a second solid of revolution having a second substantially conical shape wherein the insertion surfaces 50 are determined by the first substantially conical shape and the locking surfaces 51 (only one is visible) are determined by the surface of said second substantially conical shape. The locking surface 51 can also be referred to as an unlocking surface 51 as the geometry of this surface is adapted to enable unlocking of the pin 8,9 from the hole to which is attached.

The angles $\alpha$ and $\alpha'$ are such that the angle of the locking surface is larger than the angle of the insertion surface but substantially smaller than 90 degrees. As an example the angle $\alpha$ for the insertion surface 50 may be 14 degrees and for the angle $\alpha'$ 20 degrees. The insertion and unlocking forces may also be dependent on the friction that is experienced between the surfaces 50, 51 and the counterpart 3,7. A pin 8, 9 with such an angle $\alpha$ for insertion surface 50 can be easily inserted by pushing in a simple hole 11, 11' or 10, 10' of the board connector 3 or panel 7 respectively that is typically present for insertion of a screw or the like. The inclination of the insertion surface 50 is small to reduce the required insertion force for the pin 8,9. The pin 8, 9 may be attached to the board connector 3 or panel 7 by means of the locking surface 51 that interferes with the board connector 3 or panel 7 after the locking structure 44 has been pushed through the hole 11, 11' or 10, 10' respectively. As the pin 8,9 it to be unlocked, the angle $\alpha'$ of the locking surface 51 should be substantially smaller than 90 degrees, such that the pin 8, 9 can be released simply by pulling. However, as $\alpha'$ exceeds $\alpha$ the force to release the pin 8, 9 is larger than the force required for insertion of the pin 8, 9.

In operation the pins 8, 9 can be used instead of a conventionally applied jack screw, without a need for modifying or adapting the components 2, 3 of the connector system 1. The pins 8, 9 can replace the screws in the cable connector 2 on locations provided by the recesses 35 (see FIG. 3) and can be pushed through the threaded hole 10, 10' and/or 11, 11' in the board connector 3 and/or panel 7, as the resilient beams 43 appropriately deflect to pass the threads by the geometry of the insertion surface 50. Locking occurs after the hole 10, 10' and/or 11, 11' has been passed by the locking structure 44 as the locking surface 51 interferes with the reference planes 12, 12' wherein the holes 10, 10' and/or 11, 11' have been defined. The cable connector 2 can be released again by pulling in which situation the resilient beams deflect again by the appropriate geometry of the locking surface 51. If need be, screws can be applied later on, as the threads of the holes 10, 10' and/or 11, 11' are not substantially damaged by the insertion of the pins. This non-destructive behaviour is obtained as a result of the smooth surface of the connecting portion 52 and the rounded-off mating ends 53 together with the resiliency of the beams 43.

Figure 6:
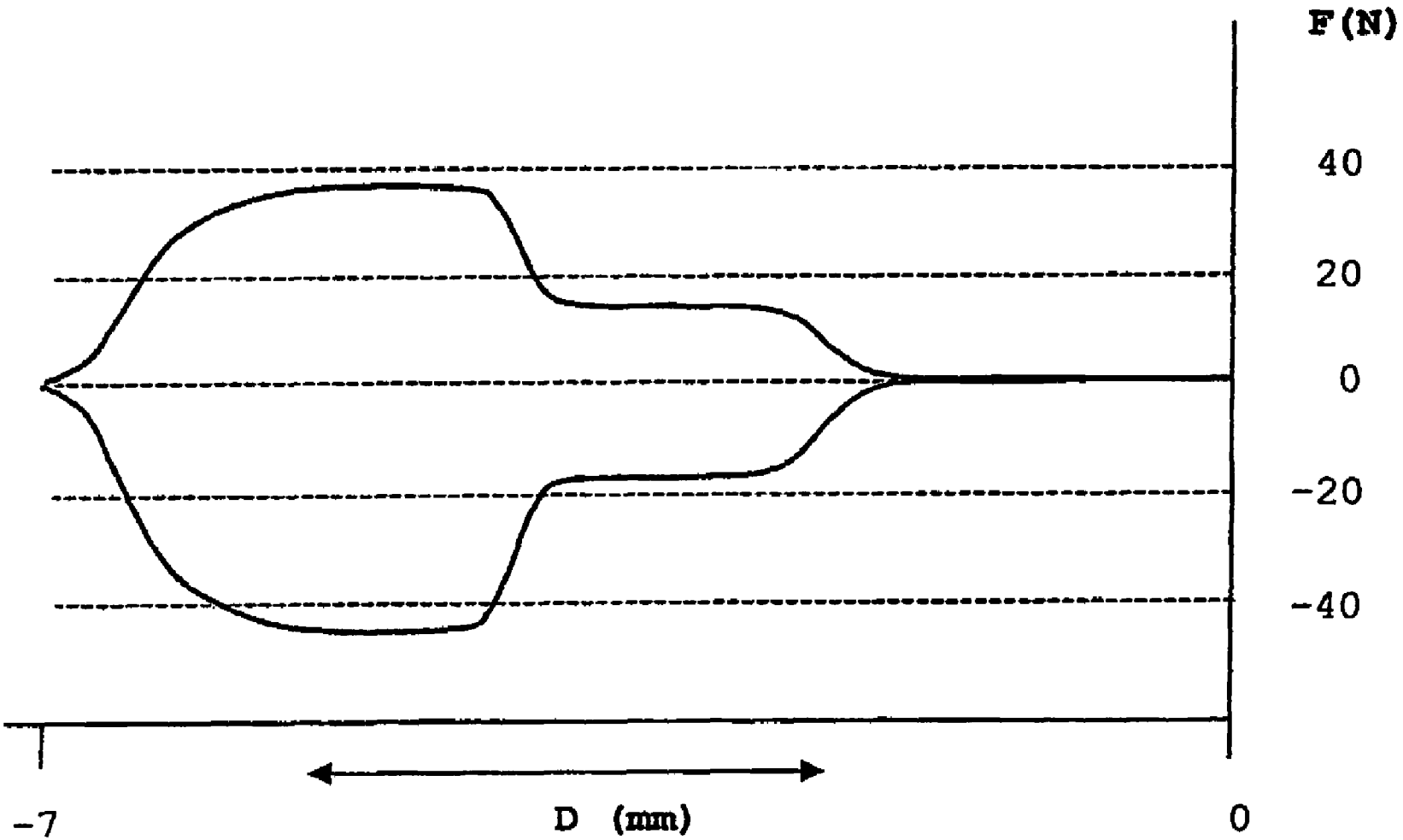
FIG. 6 shows an illustrative graph for the insertion and withdrawal characteristics of the locking element according to the first embodiment of the invention.

FIG. 6 shows an illustrative mating cycle for the insertion and withdrawal of a pin 8, 9 from a threaded hole. It was determined that the maximum forces for mating were approximately 35 Newtons for $\alpha$=14,25° and for unmating 45 Newtons for $\alpha'$=20.3°. Further the characteristics showed a decrease in the withdrawal force of about 15% after 105 mating cycles. The threaded holes were still suitable for insertion of a screw after these cycles.

Figure 7:
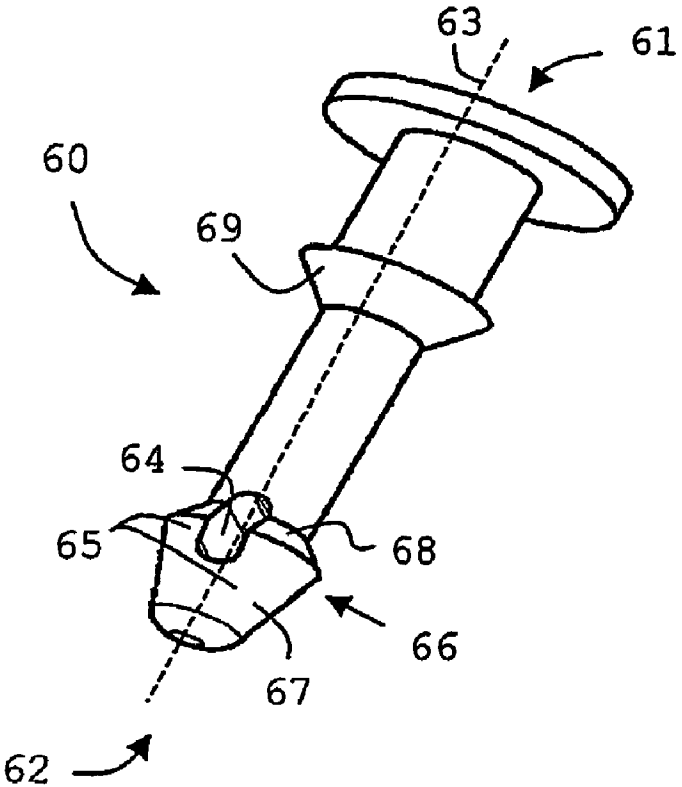
FIG. 7 shows a locking element according to a second embodiment of the invention.

FIG. 7 shows a locking element 60 according to a second embodiment of the invention extending between a rear side 61 and a mating side 62 along a longitudinal axis 63, comprising a needle eye-shaped hole 64 determining resilient beams 65, such that the beams 65 meet at the mating side 62. The beams 65 comprise a locking structure 66, comprising an insertion surface 67 and a locking surface 68 as described in more detail above. As the beams 65 are integrated at the mating side 62 to define an integrated mating end, the locking element 60 is more robust compared to the pins 8, 9 as shown in FIGS. 4A and 4B. The integrated mating end is rounded off to avoid damage in a threaded hole of a counterpart. The locking element 60 further comprises a retaining structure 69 allowing the locking element 60 to be accommodated in the spaces defined by e.g. the recesses 35 or the cable connector 2.

Figure 8:
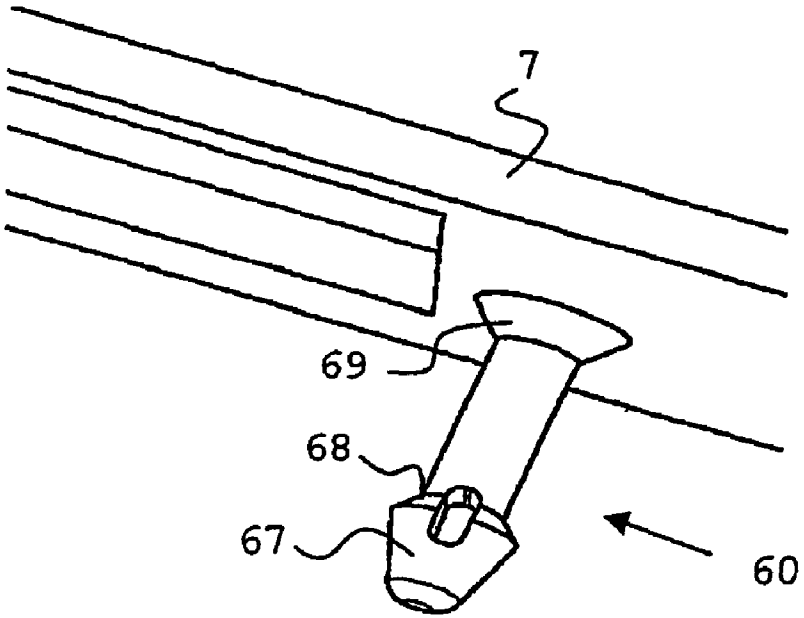
FIG. 8 shows a panel including a locking element as shown in FIG. 5.

Instead of accommodation of the locking element 8, 9, 60 in the cable connector 2 before locking, an embodiment of the invention also allows the accommodation of the locking element 8, 9, 60 in the counterpart, such as the board connector 3 or the panel 7. FIG. 8 shows an example wherein the locking element 60 of FIG. 7 is integrated in the panel 7. Such a reverse situation allows the provision of components on the circuit board 4 immediately behind the holes 10, 11.

In operation, a cable connector 2 can be locked to the panel 7 by inserting the locking element 60 through the holes, defined by the recesses 35 when the housing parts 30, 31 meet. The inclination of the insertion surface 67 with the longitudinal axis 63 is such that insertion through the holes in the cable connector is facilitated, while the inclination of the locking surface 68 is such that it provides both appropriate locking and the possibility to withdraw the cable connector from the panel 7. The retainer structure 69 fixates the locking element 60 to the panel 7.

The invention claimed is:

1. Locking element for locking and unlocking a cable connector and a counterpart, said locking element extending along a longitudinal axis between a rear side and a mating side, said mating side comprising two or more resilient beams extending substantially parallel to said longitudinal axis and containing one or more locking structures comprising an insertion surface and a locking surface disposed at angles with said longitudinal axis characterized in that said insertion surface and said locking surface have an inclined orientation with respect to said longitudinal axis wherein said angle of said locking surface is larger than said angle of said insertion surface but substantially smaller than 90 degrees, wherein a solid of revolution of said locking structure comprises a substantially conically shaped portion.

2. Locking element according to claim 1, wherein said insertion surface and said locking surface substantially determine said locking structure.

3. Locking element according to claim 1, wherein said locking element comprises one or more slits.

4. Locking element according to claim 1, wherein said mating ends of said resilient beams are rounded off.

5. Locking element according to claim 1, wherein said locking element comprises a retaining structure adapted to keep said locking element attached to either said cable connector or said counterpart.

6. Connector system comprising a cable connector and a board connector, wherein one or more locking element according to claim 1 connect said cable connector and board connector.

7. Connector system according to claim 6, said insertion surface and said locking surface substantially determine said locking structure.

8. Connector system according to claim 6, comprising two or more locking elements of different length along said longitudinal axis.

9. Connector system according to claim 6, wherein said cable connector and board connector connect to each other via an aperture in a panel, said locking element comprising a retaining structure adapted to keep said locking element attached to said panel.

10. Connector system according to claim 6, wherein board connector or a counterpart comprises a locking structure for receiving the locking element.

11. Connector system according to claim 10, wherein said locking structure comprises a threaded hole.

12. Locking element for locking and unlocking a cable connector and a counterpart, said locking element extending along a longitudinal axis between a rear side and a mating side, said mating side comprising two or more resilient beams extending substantially parallel to said longitudinal axis and containing one or more locking structures comprising an insertion surface and a locking surface disposed at angles with said longitudinal axis characterized in that said insertion surface and said locking surface have an inclined orientation with respect to said longitudinal axis wherein said angle of said locking surface is larger than said angle of said insertion surface but substantially smaller than 90 degrees, wherein said locking structure is determined by a first solid of revolution having a first substantially conical shape and a second solid of revolution having a second substantially conical shape and wherein said insertion surface is determined by a surface of said first substantially conical shape and said locking surface is determined by a surface of said second substantially conical shape.

13. Connector system comprising a cable connector and a board connector, wherein one or more locking element according to claim 12 connect said cable connector and board connector.

14. Connector system according to claim 13, wherein said insertion surface and said locking surface substantially determine said locking structure.

15. Locking element for locking and unlocking a cable connector and a counterpart, said locking element extending along a longitudinal axis between a rear side and a mating side, said mating side comprising two or more resilient beams extending substantially parallel to said longitudinal axis and containing one or more locking structures comprising an insertion surface and a locking surface disposed at angles with said longitudinal axis characterized in that said insertion surface and said locking surface have an inclined orientation with respect to said longitudinal axis wherein said angle of said locking surface is larger than said angle of said insertion surface but substantially smaller than 90 degrees, wherein said locking element comprises a hole at or near said mating side determining said resilient beams.

16. Connector system comprising a cable connector and a board connector, wherein one or more locking element according to claim 15 connect said cable connector and board connector.

* * * * *